United States Patent [19]

Kita et al.

[11] 4,259,820

[45] Apr. 7, 1981

[54] HEAT-INSULATING, ANTISWEAT STRUCTURAL COMPONENT FOR PREFABRICATED RESIDENTIAL HOUSES

[76] Inventors: Takeichi Kita; Takuji Kita, both of 2-288 Mineoka-cho, Hodogaya-ku, Yokohama, Japan

[21] Appl. No.: 62,307

[22] Filed: Jul. 31, 1979

[51] Int. Cl.[3] ..... E04B 1/70; E04F 17/04

[52] U.S. Cl. ..... 52/303; 52/381; 405/277

[58] Field of Search ..... 52/303, 380–382, 52/588, 732, 198, 576, 577; 405/276–280; 98/31

[56] References Cited

U.S. PATENT DOCUMENTS

| | | | |
|---|---|---|---|
| 341,362 | 5/1886 | Vaughan | 52/303 |
| 1,131,537 | 3/1915 | Stockman | 52/198 |
| 1,771,224 | 7/1930 | Kohler | 405/279 |
| 4,162,866 | 7/1979 | Kita et al. | 405/278 |

FOREIGN PATENT DOCUMENTS

| | | | |
|---|---|---|---|
| 524422 | 5/1931 | Fed. Rep. of Germany | 405/277 |

*Primary Examiner*—James L. Ridgill, Jr.
*Attorney, Agent, or Firm*—George B. Oujevolk

[57] ABSTRACT

A heat-insulating, antisweat structural component for prefabricated residential houses, etc. comprises a set of H-shaped steel sheet piles each having opposed side plates coupled by a coupling plate and fittingly coupled to the other in a side-by-side relationship. In each H-shaped steel sheet pile, an engaging piece is formed at one edge and a fitting piece adapted to snugly fit the engaging piece is formed at the other edge of each of the side plates in such a manner that they are continuous along the respective edges, and fitting grooves are formed centrally on the opposed surfaces of the coupling plate to extend in an opposed relationship to each other and in parallel with the side plates. A cylindrical partition member has a hollow cylindrical body and a pair of projection pieces integrally formed on the body in a symmetrical opposition to each other, and is assembled with the H-shaped steel sheet pile set, with the hollow cylindrical body being accommodated within a box-shaped cavity defined by a pair of the coupled H-shaped sheet piles and the projection pieces being snugly received in the fitting grooves in the coupling plates of the respective sheet piles. The H-shaped sheet piles have apertures formed at suitable positions and the accommodated cylindrical partition members have apertures located at the corresponding positions to those of the apertures in the pile, and a tubular piece is rigidly extending through each pair of the corresponding apertures in the pile and the cylindrical partition member.

4 Claims, 7 Drawing Figures

HEAT-INSULATING, ANTISWEAT STRUCTURAL COMPONENT FOR PREFABRICATED RESIDENTIAL HOUSES

BACKGROUND OF THE INVENTION

This invention relates to a heat insulating antisweat structural component for walls, roofs, floors, etc. for prefabricated residential houses, etc. which heat shields the interior of the residential houses from the outdoors, and at the same time is prevented from dew condensation.

DESCRIPTION OF THE PRIOR ART

Emphasis in the field of design of residential houses has been recently shifted from ventilation against hot weather in summer toward heat insulation against cold weather in winter for the sake of energy saving. For example, the number of houses is increasing where the spaces below the floors are shielded against cold air flow. A degree of tightness of the room interiors must be more or less increased for the purpose of heat insulation. Consequently, moisture originating in the room interiors is not to be released to the outdoors, but may enter the closed interiors of walls or double walls where it prompts corrosion of the components as unnoticed or helps in combination with heat generating a favorable environment for proliferation of wood rotting fungi, such as merulius lacrymans, to cause destruction of house structures.

Objects of the Invention

One object of the invention is to provide a heat insulating, antisweat structural component for prefabricated residential houses, etc.

Another object of the invention is to provide a structural component for prefabricated houses which renders the constructions of houses heat-insulatory and improves ventilation of the insides of structures of walls, roofs, floors, etc. to permit moisture to be expelled therefrom, thus avoiding the problem of dew condensation.

A further object is to provide a structural component for prefabricated houses which renders the constructions of houses heat-insulatory and avoids the problem of dew condensation, to destroy the habitable environments for wood rotting fungi, thus contributing to comforts and durability of energy-saving houses.

DETAILED DESCRIPTION OF PREFERRED EMBODIMENTS

Figure 1:
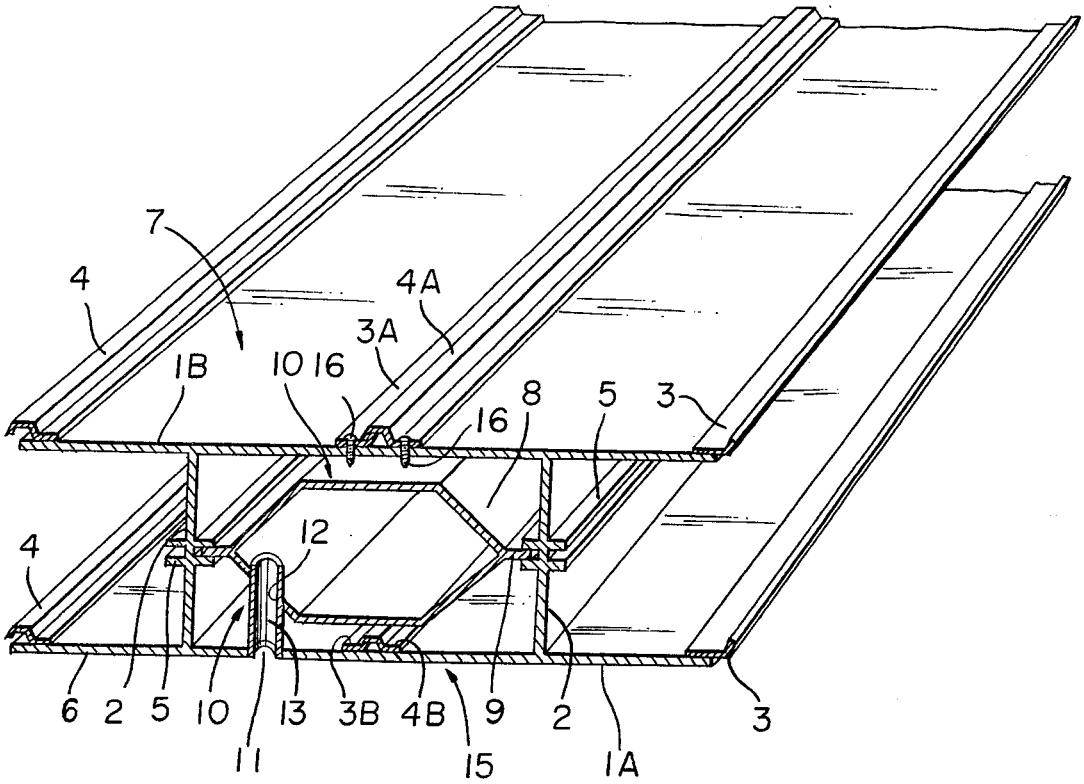
FIG. 1 is a perspective view showing a componential arrangement embodying the invention.
Figure 3:
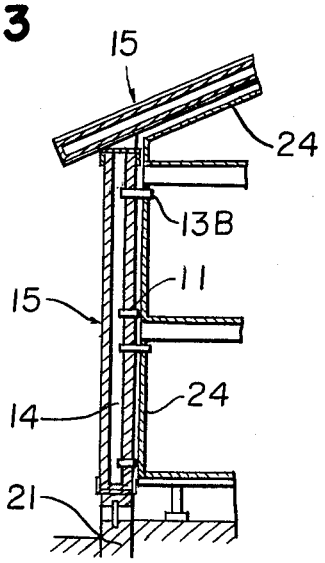
FIG. 3 is a diagrammatical view of a house having a wall structure, roof structure and floor structure formed similarly as in FIG. 2.
Figure 2:
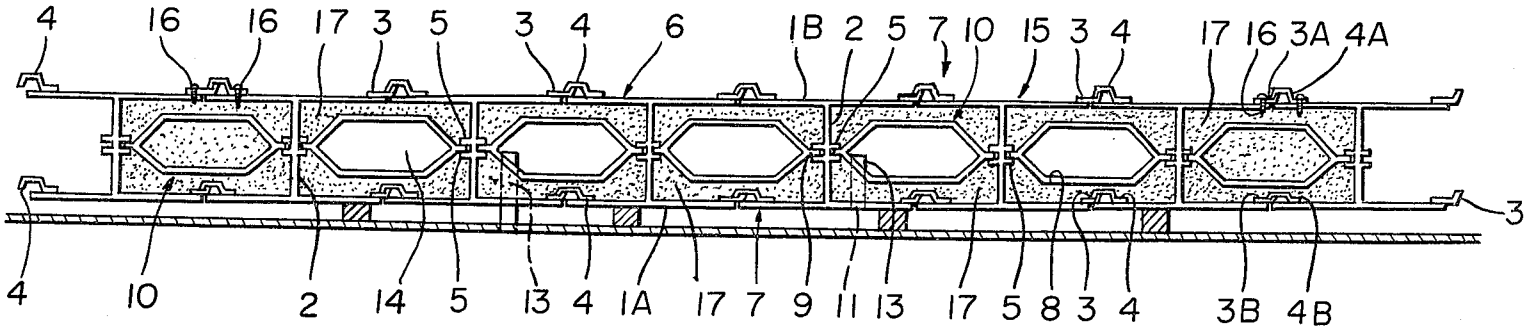
FIG. 2 is a plan view showing an end face of a wall structure formed by the assembled unit arrangement of FIG. 1.
Figure 4:
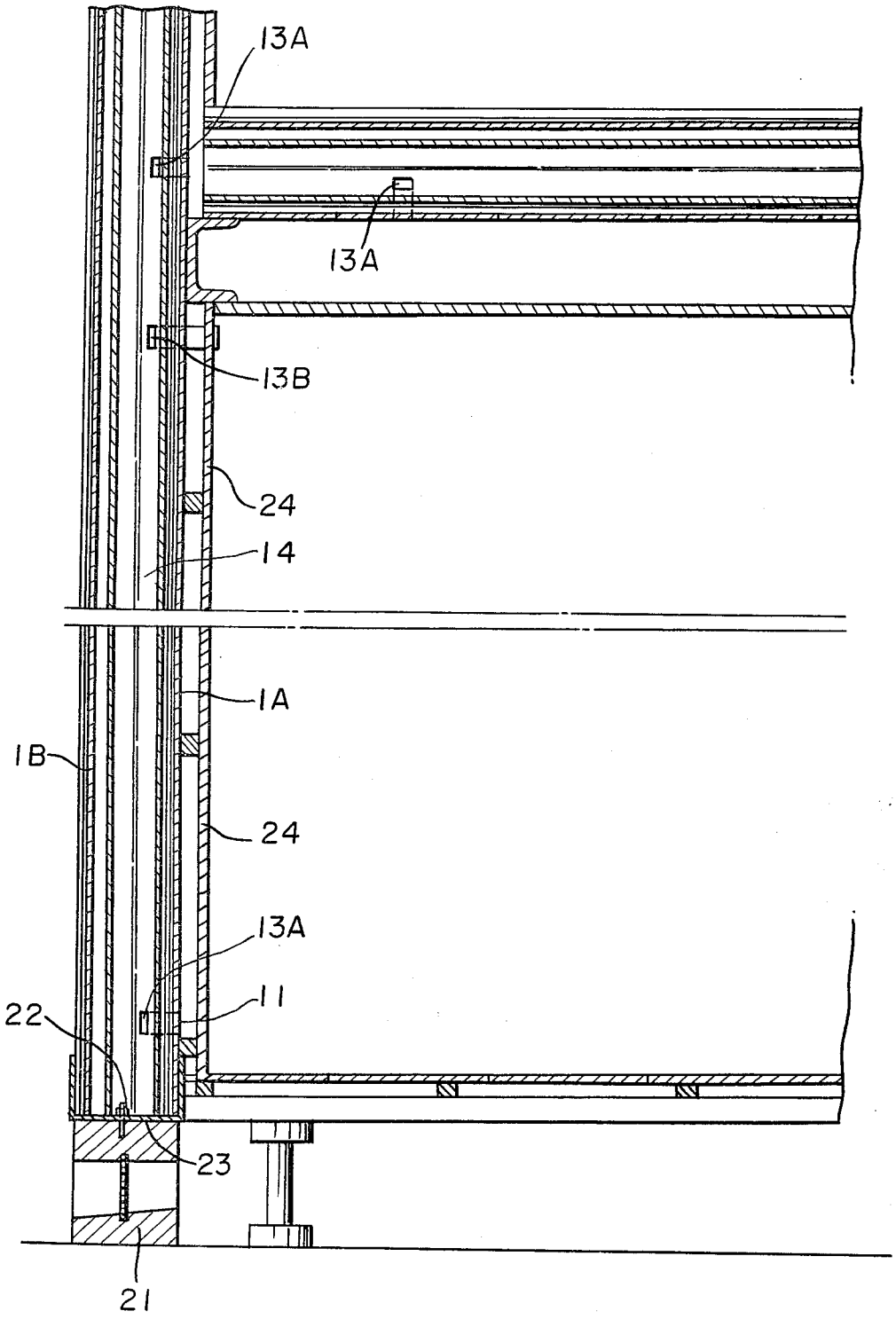
FIG. 4 is an enlarged diagrammatical view of the house structure of FIG. 3.
Figure 5:
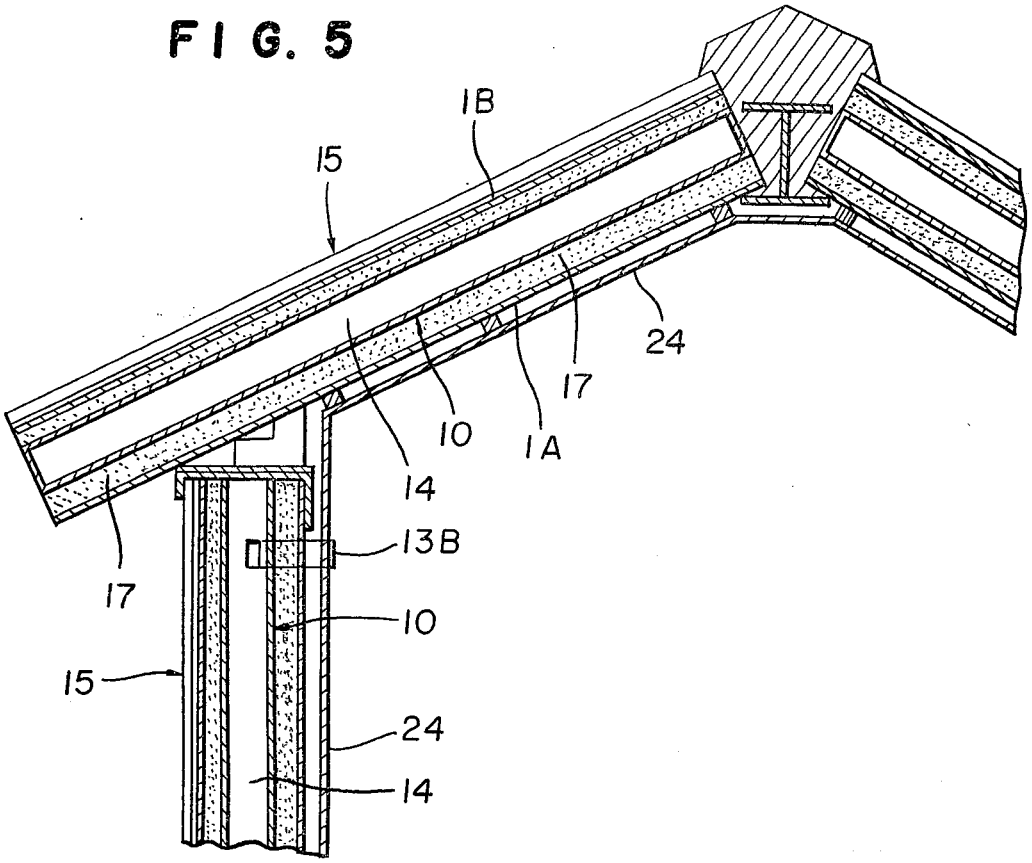
FIG. 5 is an enlarged diagrammatical view of joining portions of the roof and the wall structures shown in FIG. 3.
Figure 6:
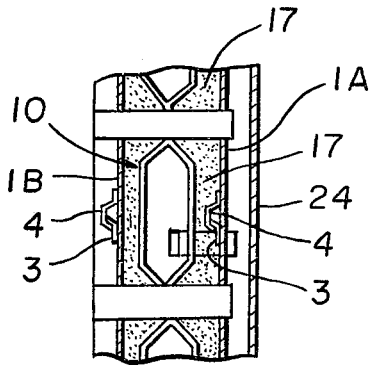
FIG. 6 is a plan view of the wall structure of FIG. 5.
Figure 7:
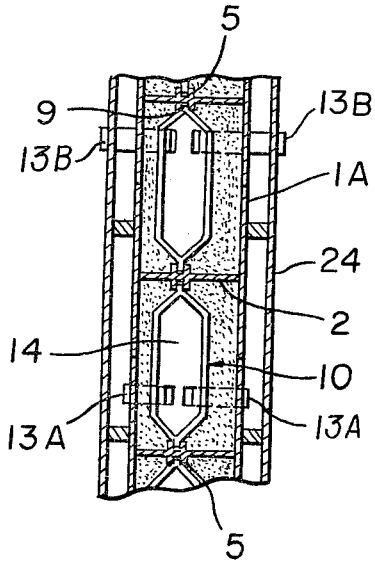
FIG. 7 is a plan view of a modification of the wall structure.

A structural component embodying the invention comprises a set 7 of H-shaped steel sheet piles 6 each having opposed side plates 1A and 1B coupled by a coupling plate 2 and fittingly coupled to the other in a side-by-side relationship. In each H-shaped steel sheet pile, an engaging piece 3 is formed at one edge and a fitting piece 4 adapted to snugly fit the engaging piece 3 is formed at the other edge of each of the side plates in such a manner that they are continuous along the respective edges, and fitting grooves 5 are formed centrally on the opposed surfaces of the coupling plate to extend in an opposed relationship to each other and in parallel with the side plates. A cylindrical partition member 10 has a hollow hexagonally cylindrical body 8 and a pair of projection pieces 9 integrally formed on the body 8 in a symmetrical opposition to each other, and is assembled with the H-shaped steel sheet pile set, with the hollow cylindrical body 8 being accommodated within a box-shaped cavity defined by a pair of the coupled H-shaped sheet piles and the projection pieces 9 being snugly received in the fitting grooves 5 in the coupling plates of the respective sheet piles. The H-shaped sheet pile set 7 has apertures 11 formed at suitable positions and the accommodated cylindrical partition members 10 have apertures 12 located at the corresponding positions to those of the apertures 11 in the pile set 7, and a tubular piece 13 is rigidly extending through each pair of the corresponding apertures 11 and 12 in the pile set 7 and the cylindrical partition member 10.

The cylindrical body 8 may have any other cross-sectional shape than stated above.

At least one pair of the H-shaped steel sheet piles 6 referred to above are coupled to therebetween define a box-shaped cavity in which a cylindrical partition member 10 is disposed with the projection pieces 9 fitted in the fitting grooves 5. Such unit assemblies can be prepared in plants. They may be or not be provided with a tubular piece or pieces 13 extending through apertures 11 and 12 to communicate a hollow cavity 14 of the cylindrical members 10 to the exterior. The assemblies which have the hollow cavities 14 of cylindrical members 10 without any communicating tubular piece may be either filled therein with a heat insulatory material or simply closed at the ends. These types of unit assemblies are combined in a determined order and coupled to each other on the spot, where the spaces in the box-shaped cavities outside of the cylindrical members 10 are filled with mortar 17 to form a structure of walls, roofs and/or floors. To facilitate fitting of the unit assemblies, the engaging and fitting pieces may be removably mounted on one side of the unit assemblies, as shown at 3A, 4A, by means of screws 16,16, while they may be brazed on the other side of the unit assemblies as shown at 3B,4B. When the unit assemblies are fitted together, the engaging and the fitting pieces 3A,4A located on the one side of the unit assembly are removed therefrom, to first engage the engaging piece 3B in the fitting piece 4B on the other side. After the brazed pieces 3B and 4B are locked together, the removed pieces 3A and 4A may be set by means of the screws 16,16 in a locking relationship with each other.

To provide a wall structure of a residential house, specifically, anchor bolts 22 are planted in a rigid foundation 21 which is provided on the upper surface with a foundation fitting 23. The fitting is horizontally levelled and has an appropriate shape to snugly receive the lower portion of a unit assembly of the invention. The unit assemblies are fitted at the opposed edges to lie in a side-by-side contiguity to each other with the cavities 14 of cylindrical members 10 being continuous to the level of the cross beam, and the spaces in the box-shaped cavities outside of the cylindrical members 10 being charged and filled with mortar 17. Some 13A of the tubular pieces 13 have the outer end openings positioned in the spaces between the unit assemblies and interior finish wall members 24, to serve to ventilate the interiors of the double wall through the cavities 14 of the cylindrical members 10 from the outdoors, thus contributing to prevention of dew condensation and proliferation of wood rotting fungi. The other tubular pieces 13B extend through the interior finish wall members 24 to have the outer end openings positioned in the room interior which is thus outdoors ventilated with a clear, fresh air. Fan devices may be provided relative to the tubular pieces 13B which can be operated at the opposed directions of rotation for expelling an interior air to the outdoors and sending an outdoor air to the room interior. The room interior can be thus air-conditioned.

Any roof and floor structures can be provided on the spot in a similar manner as the wall structure, probably except that no tubular pieces having the outer end openings in the room interior are provided, but those with the end openings in the spaces between the interior finish siding members and the unit assemblies to ventilate any inner spaces of the componential structures.

Only spaces located in the box-shaped cavities on one side of the cylindrical member 10 are filled with mortar, and the spaces on the other side remain free.

When a cooperative house is to be built with the unit assemblies of the invention, a wall structure to be co-owned may have apertures 11 in both of the opposed side plates 1A and 1B, with corresponding apertures 12 being formed in the cylindrical member 10, and tubular pieces 13 may be disposed through the respective pairs of apertures 11 and 12 to ventilate the cavity of the cylindrical member 10 to room interiors on the both sides of the wall structure.

As obvious from the foregoings, the structural component of the invention has a strengthened arrangement of unit assembly consisting of a set of H-shaped steel sheet piles fittingly coupled side-by-side to each other at the edges of the side plates of each H-shaped pile to define box-shaped cavities therebetween, and cylindrical members snugly accommodated in the cavities referred to. Filling of mortar in the space in the box-shaped cavities outside of the cylindrical members permits provision of heat- or sound insulatory wall, roof and floor structure comprised of the unit assemblies. In the structure, the hollow cavities of the accommodated cylindrical members are communicated to the outside of the unit assemblies permit to spontaneous ventilation of the inner spacings in the wall, roof and floor structures, thus avoiding retention of moisture and accordingly dew condensation, and resulting in elimination of decaying damages of structural components by action of moisture and fungi. In the light of these, the structural component of the invention contributes to provision of comfortable, durable, energy-saving residential houses.

What is claimed is:

1. A heat-insulating, antisweat structural component for prefabricated residential houses comprising a set of H-shaped steel sheet piles each having opposed side plates coupled by a coupling plate and fittingly coupled to the other in a side-by-side relationship, each of said H-shaped steel sheet piles having an engaging piece formed at one edge of each of said side plates and a fitting piece formed at the other edge of each of said side plates to be adapted to snugly fit said engaging piece, and fitting grooves formed centrally or the opposed surfaces of said coupling plate to extend in an opposed relationship to each other and in parallel with said side plates, at least one cylindrical partition member having a hollow cylindrical body and a pair of projection pieces integrally formed on said body in a symmetrical opposition to each other, and assembled with said set of the H-shaped steel sheet piles, with said hollow cylindrical body being accommodated within a box-shaped cavity defined by a pair of the coupled H-shaped sheet piles and said projection pieces being snugly received in the fitting grooves in the coupling plates of the respective sheet piles, said H-shaped steel sheet piles having apertures formed at suitable positions and said accommodated cylindrical partition member having apertures located at the corresponding positions to those of said apertures in said steel sheet piles, and a tubular piece rigidly extending through each pair of said corresponding apertures in said steel sheet piles and said cylindrical partition members.

2. The heat-insulating, antisweat structural component for prefabricated residential houses defined in claim 1 where some of said cylindrical members are nonperforate, said non-perforate members being filled with a heat-insulating material or closed at the ends.

3. The heat-insulating, antisweat structural component for prefabricated residential houses defined in claim 1 and comprising a unit assembly consisting of at least one pair of said H-shaped steel sheet piles, said cylindrical partition member and said tubular piece.

4. The heat-insulating, antisweat structural component for prefabricated residential houses defined in claim 3 and comprising a plurality of said unit assemblies successively fittingly coupled to each other, with a space in a box-shaped cavity outside of said cylindrical partition member being filled with ortar.

* * * * *